US008029118B2

(12) United States Patent
Albertin et al.

(10) Patent No.: US 8,029,118 B2
(45) Date of Patent: Oct. 4, 2011

(54) INK JET PRINT CARTRIDGE WITH INDEPENDENT ADJACENT SEALING PLUGS

(75) Inventors: Alberto Albertin, Arnad (IT); Rinaldo Ferrarotti, Arnad (IT)

(73) Assignee: Telecom Italia S.p.A., Milan (IT)

( * ) Notice: Subject to any disclaimer, the term of this patent is extended or adjusted under 35 U.S.C. 154(b) by 485 days.

(21) Appl. No.: 11/921,043

(22) PCT Filed: May 25, 2005

(86) PCT No.: PCT/IT2005/000298

§ 371 (c)(1),
(2), (4) Date: Feb. 6, 2009

(87) PCT Pub. No.: WO2006/126217

PCT Pub. Date: Nov. 20, 2006

(65) Prior Publication Data

US 2009/0213195 A1 Aug. 27, 2009

(51) Int. Cl.
*B41J 2/175* (2006.01)

(52) U.S. Cl. ..... 347/87

(58) Field of Classification Search ..... 347/43, 347/86, 87

See application file for complete search history.

(56) References Cited

U.S. PATENT DOCUMENTS 5,831,653 A 11/1998 Brandon et al.
6,260,961 B1 7/2001 Seu et al.
6,293,664 B1 9/2001 DeFosse et al.
6,331,054 B1 * 12/2001 Seu et al. ..... 347/87
6,733,118 B2 5/2004 Pingrey et al.
6,811,250 B2 11/2004 Buchanan et al.
6,851,800 B1 2/2005 Seu
7,517,068 B2 * 4/2009 Jung et al. ..... 347/86
2004/0095447 A1 5/2004 Bailey et al.
2004/0201653 A1 10/2004 Shyu et al.

OTHER PUBLICATIONS

International Search Report dated Feb. 15, 2006 issued in PCT/IT2005/000298.

* cited by examiner

*Primary Examiner* — Anh T. N. Vo
(74) *Attorney, Agent, or Firm* — Venable LLP; Robert Kinberg; Steven J. Schwarz

(57) ABSTRACT

A Multi-color ink-jet print cartridge includes an integrally shaped one-piece body with a reservoir portion including at least two ink chambers, and a manifold portion including at least two ink conduits, each ink conduit hydraulically connected to a corresponding one of the ink chambers through a port. An ink-jet printhead, includes at least two nozzle arrays, each of which arrays is hydraulically connected to a corresponding one of the ink conduits. A lid covers the reservoir portion of the body. Each of the ink conduits includes a channel portion in side to side relationship with the corresponding channel portion of the adjacent ink conduit. The channel portions have adjacent openings on one external wall of the body. Separate independent plugs are sealingly inserted into the adjacent openings.

11 Claims, 3 Drawing Sheets

INK JET PRINT CARTRIDGE WITH INDEPENDENT ADJACENT SEALING PLUGS

CROSS-REFERENCE TO RELATED APPLICATIONS

Figure 1:
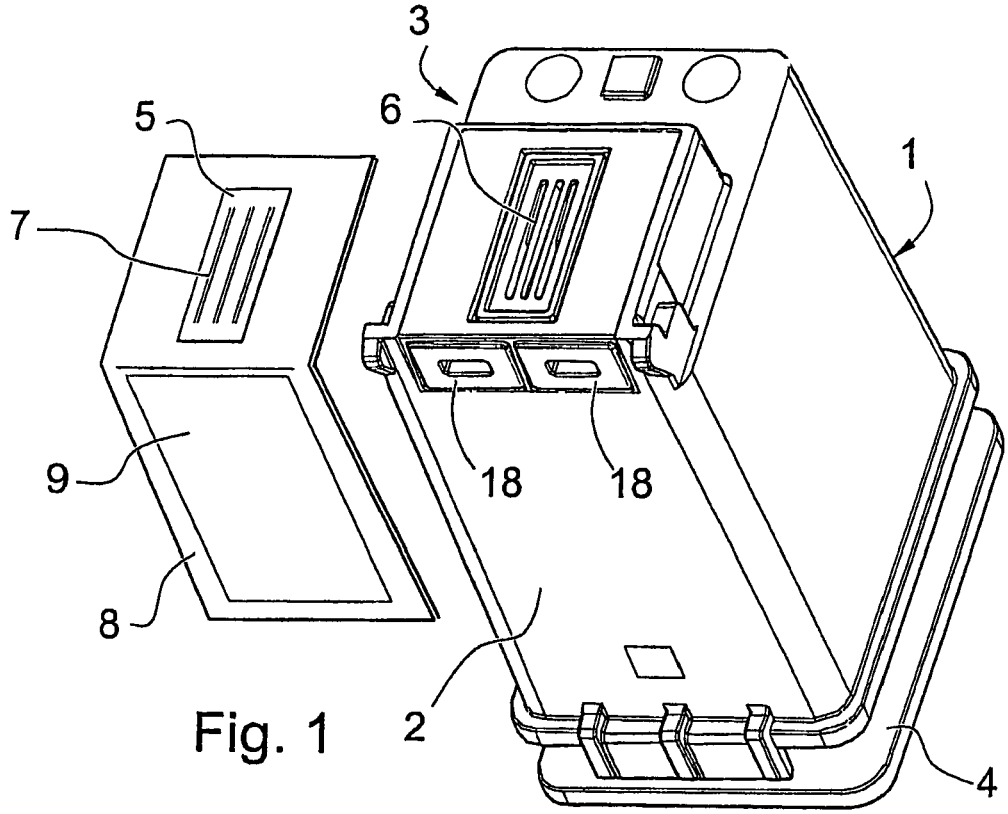

This application is a National Stage of International Application No. PCT/IT2005/000298 filed May. 25, 2005, designating the United States the entire contents of which is incorporated herein by reference.

The present invention is concerned with a multi-color ink-jet print cartridge.

Ink-jet printers are broadly used both for office and business printing and for home printing. In particular, ink-jet printers are particularly suitable for color printings, such as photographic printing, presentation printing or the like. Such printers are suitable to be connected to an image or text source, such as computer, a photocamera, a fac-simile equipment or the like, and print the desired image or text over a printing medium, such as paper, photographic paper or the like.

Typically, ink-jet printers include a printing machine equipped with a medium (e.g. paper) advancing mechanism and with a movable carriage, suitable to carry one or more printing cartridges and to traverse said cartridges over said medium.

In a particularly convenient embodiment, a cartridge includes one or more separate reservoirs, to contain a certain amount of ink, and a printhead, including electronic and hydraulic circuits to operate the ink ejection through one or more nozzle arrays provided on the printhead.

More conveniently, such cartridge is replaceable with the relevant printhead when the ink in the reservoir is finished.

For multi-color printing, conveniently a cartridge includes some separate reservoirs which independently supply separate nozzle arrays of the printhead.

Such cartridges include a body having a complex shape, suitable to provide said reservoirs and the relevant ink paths. Conveniently, the cartridge body is obtained by injection moulding of a thermoplastic material.

US2004/0095447 discloses a body for multi-color ink cartridges in which a thermoplastic material is injected into a mold to form a cartridge body. After the body has solidified, but before the body is removed from the mold, mold inserts are removed from ink flow paths and pins are inserted to block the flow of injection molded plastic material in ink flow paths. Next an injection tool is partially inserted in access ports to inject molten plastic material therein to form integrally molded plugs closing the access ports. The process described above is referred to as a "two shot" molding process, because two shots of molten plastic material are inserted in the mold for body. The first shot of thermoplastic material provides body and the second shot of thermoplastic material provides plugs. No exterior wall opening is required for a mold insert to form the ink flow paths for the cartridges. Hence, no separate cover is required to close such wall openings.

U.S. Pat. No. 6,811,250 discloses an inkjet print head having a unitary body with ink compartments each having ink outlet port, ink feed slots, and ink conduit plugs laser welded over opening of ink conduits. In particular, during unitary body manufacturing, various core pins on the molding slide and cause opening of the ink conduit to form along the exterior of the body. If left open or unsealed, such opening would allow ink to leak during use. Thus, ink conduit plugs provide the sealing of the openings. To prevent contamination and/or clogging of the ink conduits and nozzle holes from flash particles, the ink conduit plugs are laser welded to seal the openings of the ink conduits.

Such body requires a complex and costly mould and the laser welding of the plugs is also a complex and expensive operation in the cartridge manufacturing process.

U.S. Pat. No. 6,851,800 discloses a single-piece print cartridge body for use in ink-jet cartridge, which has a printhead and a single cap disposed over an aperture in wall of the body. Prior art ink-jet cartridges have a cartridge body in a one-piece injection-molded part, and two mold-slide-inserts, one for each ink delivery channel. After molding, the two mold-slide-inserts are removed from the body, leaving behind two openings and a plug subsequently seals each mold-slide-insert access hole. Using two mold-slide-inserts often requires using relatively slender mold-slide-inserts that can be fragile and susceptible to excessive creep and that may require excessive maintenance. Moreover, the use of two plugs and two mold-slide-inserts can be costly from a manufacturing standpoint. In one embodiment, print cartridge body includes a cap disposed over an aperture (or a mold-slide-insert access hole) in wall that opens to cavities and channels.

U.S. Pat. No. 6,260,961 discloses a multi-compartment ink-jet cartridge body structure in which the body and manifold structure are formed as a unitary one-piece structure. A lid is attached to the unitary body to cover the compartments. The body includes an external wall, and an access opening is formed in the wall adjacent the manifold structure. A seal structure attached to the body for sealing the access opening. The body structure can be fabricated by a plastic material using an injection molding process. The access opening is a mold slide insert opening in the nosepiece area, and the seal structure seals the slide insert opening. The molding process can be carried out by a three piece mold set to fabricate the body.

U.S. Pat. No. 6,733,118 discloses a side plug for an ink-jet printer cartridge, including sealing portion for closing mold slide insert access hole, and protuberance for forming ink manifold channel. The side plug seals a mold access hole in the cartridge body. The side plug is preferably formed of a carbon fiber filled PET (Polyethylene Terephthalate) material; the carbon content of the side plug allows microwave curing of the epoxy adhesive used to attach the side plug to the cartridge body. Microwave curing is used in order to avoid problems caused by bonding plastic parts together with heat cured adhesives due to difficulties encountered in heating the adhesive.

US2004/0201653 discloses an inkjet cartridge in which, when the body of the ink-jet cartridge is integrally formed by injection molding, an opening, located in a sidewall of the body, is sealed by a member. To prevent intermixture of different inks due to errors in the manufacturing process, only a single opening, sealed by single member is provided. This has been obtained with a special design of the channels in the cartridge body.

However, the Applicant has observed that a cartridge body design suitable for low cost molding may result in ink leakage or ink contamination problems, deriving from defects in ink channels sealing. Such defects in ink channels sealing are detected in the test phases at the end of the cartridge manufacturing process and the pieces showing the defect are discarded. As a consequence, this causes a reduction of the cartridge manufacturing process yield.

According to the present invention, the Applicant has perceived that such defects are caused by the design of the ink channels in the cartridge body and, more specifically, by the design of the piece which seals the openings through which said channels are molded.

The Applicant has perceived that while a convenient design of the cartridge body, particularly from the low cost molding point of view, has adjacent openings for the formation of the internal ink delivery channels in the cartridge body, the risk of ink leakage or ink contamination deriving from defects in ink channels sealing can be substantially avoided or significantly reduced by providing separate and independent plugs to seal the openings.

Preferably, said separate plugs are sealed in said adjacent openings by means of a thermally cured adhesive.

This construction provides an effective seal minimizing products failure due to leakages or ink intermixing, and enables to produce the cartridge with a cost effective process.

In a first aspect the present invention concerns a multi-color ink-jet print cartridge, comprising:

an integrally shaped one-piece body having:

a reservoir portion including at least two ink chambers;

a manifold portion including at least two ink conduits, each ink conduit hydraulically connected to a corresponding one of said ink chambers through a port;

an ink-jet printhead, including at least two nozzle arrays, each of said nozzle arrays hydraulically connected to a corresponding one of said ink conduits;

a lid to cover said reservoir portion of the body;

each of said ink conduits including a channel portion in side to side relationship with the corresponding channel portion of the adjacent ink conduit, said channel portions having adjacent openings on one external wall of said body;

wherein separate independent plugs are sealingly inserted into said adjacent openings.

In particular, two independent seals seal said plugs into said adjacent openings.

Preferably, said plugs include front flanges and said body includes separate recesses for said front flanges around said adjacent openings.

More preferably, an adhesive layer is interposed between each said front flange and said recess.

Preferably, said body includes an end wall between the adjacent openings of said channel portions, the end wall having a side flush with an outer surface of one external wall of said body.

Preferably, said plugs are symmetrical in one longitudinal plane thereof. More preferably, said plugs are symmetrical in both the orthogonal longitudinal planes thereof.

According to a second aspect the present invention concerns a process for manufacturing a multi-color ink-jet print cartridge, which comprises the steps of:

injection molding a one-piece body, including a top opening and at least two adjacent front openings in side to side relationship on a body external wall;

sealing said top opening with a lid;

sealing said front openings;

assembling a printhead on said body, and filling said cartridge with at least two different inks;

in which said step of sealing said front openings includes sealing said openings with two independent plugs.

Preferably, the step of sealing said front openings includes laying a separate layer of adhesive material around each of said openings.

More preferably, said layer of adhesive material is thermally cured; still more preferably, curing said layer of adhesive material includes blowing hot air.

Figure 3:
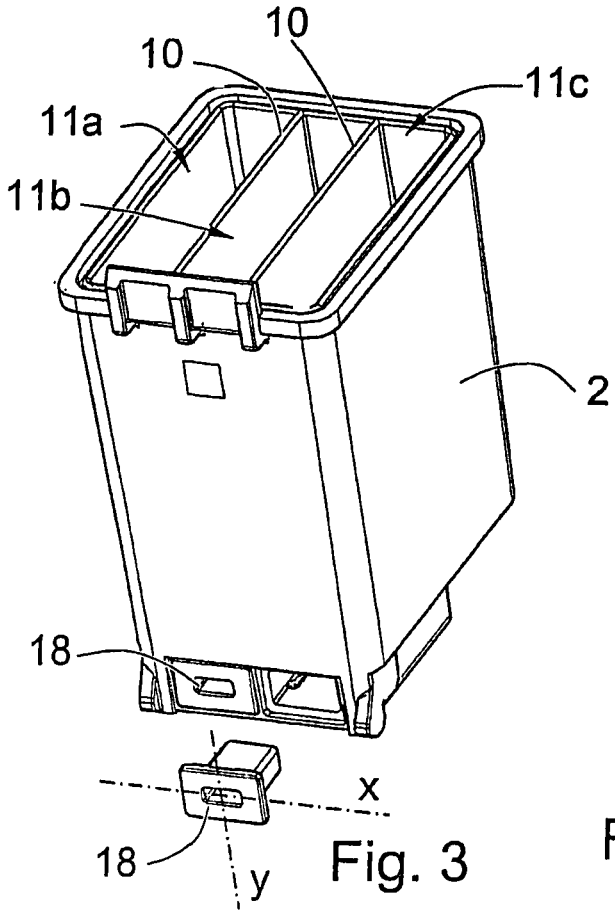
Figure 2:
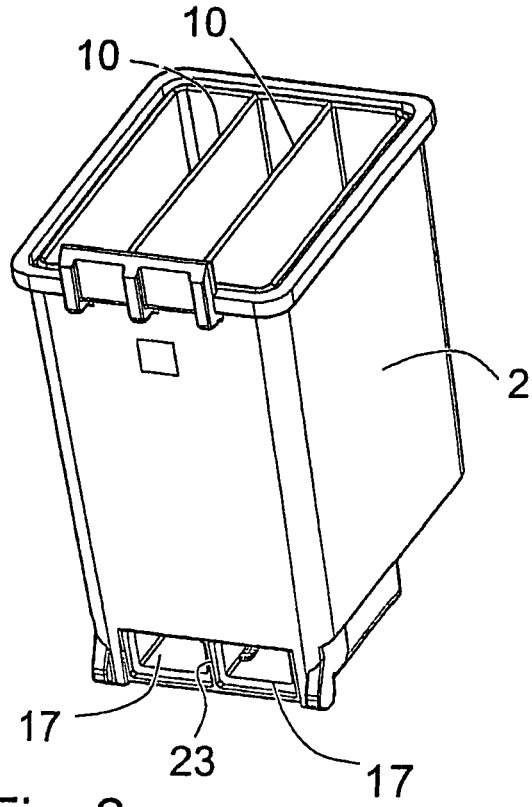
Figure 4:
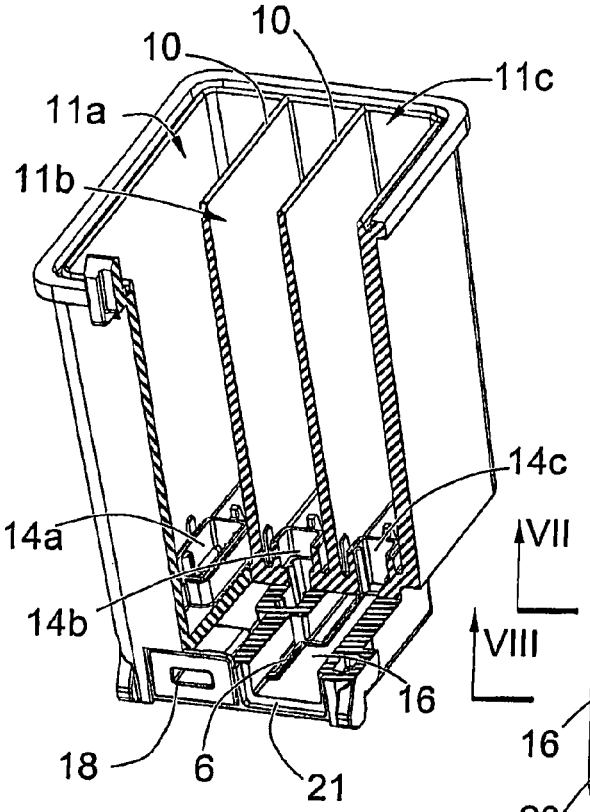
Figure 5:
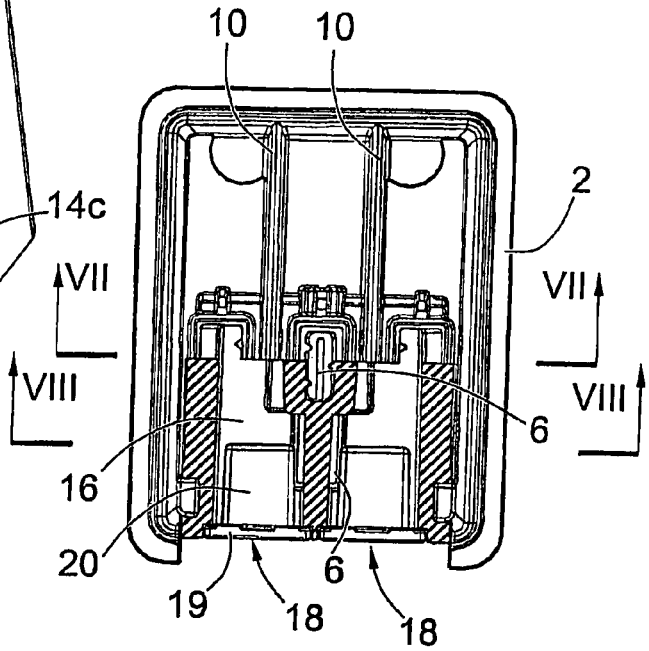
Figure 6:
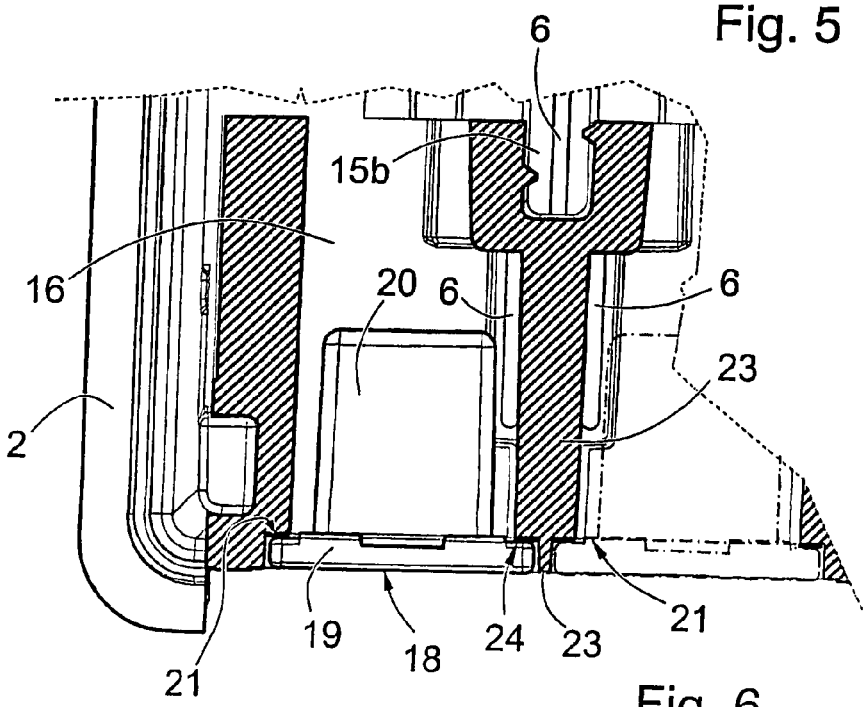
Figure 7:
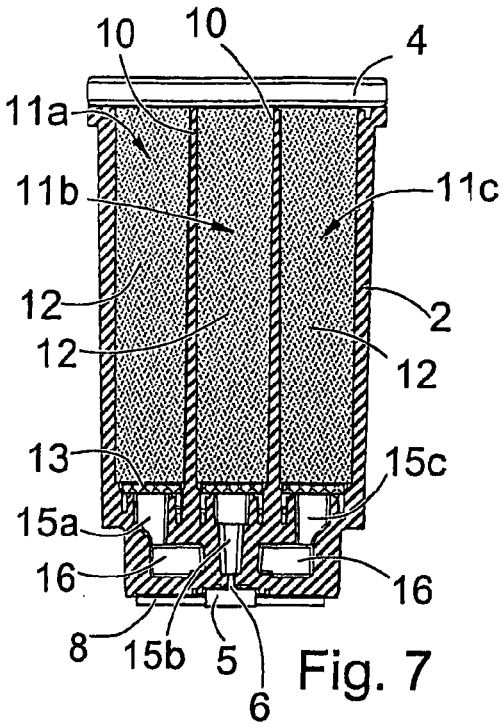
Figure 8:
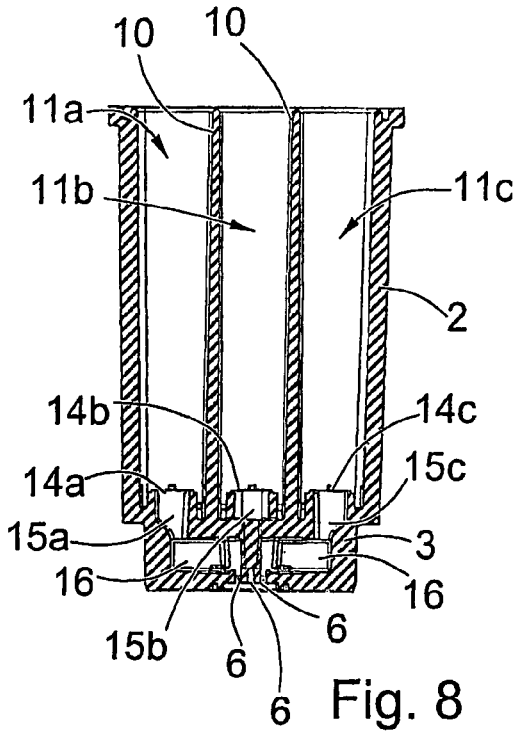
Figure 9:
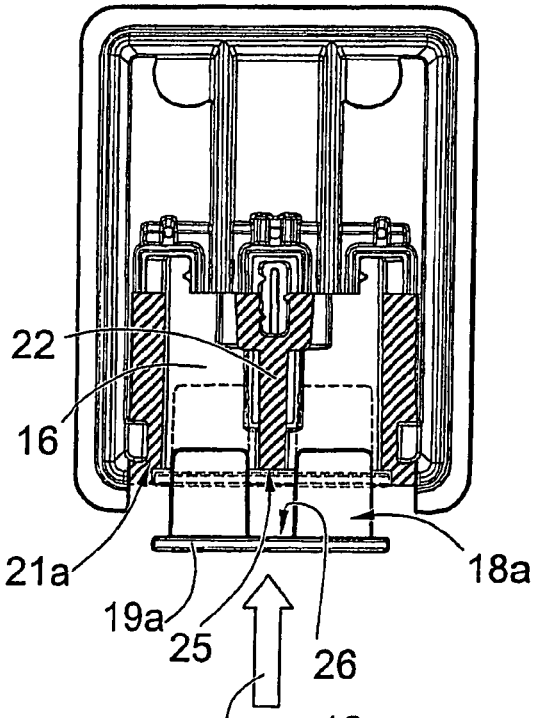
Figure 10:
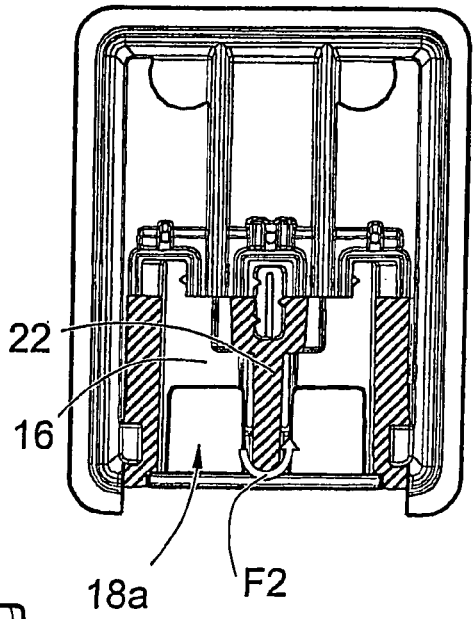
Figure 11:
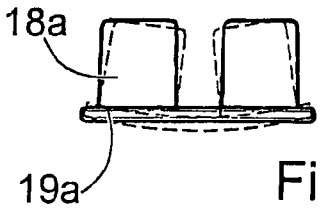

Further details of an exemplary embodiment of the present invention are described in the following, with reference to the attached drawings, which show:

In FIG. 1 an exploded view of a cartridge according to the invention;

In FIG. 2 a perspective view of the body of the cartridge of FIG. 1, without sealing plugs;

In FIG. 3 an exploded view of the cartridge body according to the invention, with one sealing plug removed from its seat;

In FIG. 4 a perspective view of the cartridge body, partly in section;

In FIG. 5 a top view of the cartridge body, partly in section, with sealing plugs;

In FIG. 6 an enlarged portion of the cartridge body of FIG. 5;

In FIG. 7 the assembled cartridge in section along the plane VII-VII of FIG. 5;

In FIG. 8 the cartridge body in section along the plane VIII-VIII of FIG. 5;

In FIG. 9 a top view of a cartridge body according to the prior art, with sealing plug being inserted in its seat;

In FIG. 10 a top view of a cartridge body according to the prior art, with sealing plug in its seat;

In FIG. 11 the sealing plug according to the prior art.

As shown in FIG. 1, an ink-jet cartridge comprises a body 1, which includes a reservoir portion 2 and a manifold portion 3.

The body 1 is closed by a lid 4 and a printhead 5 is placed over the manifold portion 3 of the body in alignment with ink delivery slots 6 of the manifold portion 3.

The printhead 5 includes an integrated circuit and arrays of ejecting nozzles and is attached to a flat cable 8 bearing electrical contacts 9 (schematically shown) and conductors to supply power and control signals to the integrated circuit of the printhead 5.

In assembled position, the printhead 5 and its flat cable 8 are connected to the manifold portion 3, typically by an adhesive or the like.

The connection is such that the ink delivery slots 6 of the body are in alignment with corresponding slots of the printhead 5.

The adhesive laid between the printhead and the body ensures that the ink delivery slots 6 are hydraulically separated from each other, so as to allow the correct independent flow of the different inks to the relevant slots of the printhead 5 and to prevent mixing of different colors.

The reservoir portion 2 of the body 1 has internal parallel dividing walls 10, which define three chambers 11*a*, 11*b*, 11*c*. Such chambers II are intended to house inks of different colors.

Within the present specification, by inks of different colors we mean either different colors, such as, for example, yellow, magenta, cyan, or different intensities of the same color, such as for example dark gray, medium gray, pale gray or the like, or, more in general, inks or other ejectable liquids having different properties or purposes which should never mix together before application on a medium during printing. In the following, any of such liquids will be synthetically referred to as ink (unless more specifically defined where necessary).

In each compartment 11 a foam piece (or sponge) 12 is inserted, to be impregnated with the relevant ink. At the bottom of each foam piece, a filter 13 is provided, in order to prevent dust or the like to enter into the ink delivery system of the cartridge.

The filters 13 are located over pipes 14*a*, 14*b*, 14*c* extending upwards from the lower surface 14 of the reservoir portion 2 of the body 1.

The pipes 14*a*, 14*b*, 14*c* are in hydraulic communication with the slots 6 through the respective independent conduits 15*a*, 15*b*, 15*c* and, as far as the two side conduits 15*a*, 15*c* are concerned, the two channels 16, in order to deliver ink from the sponges 12 to the slots 6 (and to the printhead hydraulics).

As can be seen from FIGS. 4 and 7, the central chamber 11*b* is in direct connection through its pipe 14*b* and the conduit 15*b* with the central one of the slots 6. As shown in FIG. 5, the conduit 15*b* is in direct alignment with the rear portion of the central one of the slots 6.

Because of the proximity of the slots 6, the connection of the two side chambers 11*a*, 11*c* with the side ones of the slots 6 requires to form the channels 16 within the manifold portion 3 of the body 1.

Preferably, the body 1 is obtained as single piece by injection molding.

With this technology, in order to minimize the costs, the inner elements of the body are made with a first mould slide insert element inserted from the upper open side of the reservoir 2 and with a second mould slide insert element inserted in the front face of the body to form the channels 16. The use of a single second mould slide insert element to form both the channels 16 is particularly convenient to keep the overall cost of the mould low, particularly in that a single movement of such single second mould slide insert element is sufficient to form both the channels 16.

As shown in FIG. 2, such second mould slide insert element, once extracted from the molded body 1, leaves two side-by-side arranged openings 17. Such openings require to be closed in use in order to deliver ink from relevant chambers 11*a*, 11*c* to the lateral slots 6 without leakages.

According to the present invention, such openings 17 are closed by two separate, independent plugs 18. When the cartridge is finally assembled, the plugs 18 are covered by the flat cable 8.

As shown in FIGS. 5, 6, the plugs 18 comprise a front flange 19 and an extension 20.

The front flange 19 of the plugs 18 is wider than the extension 20 and is such to abut, in assembled position, against the surface of a recess 21 of the manifold portion 3 of the body 1, surrounding the relevant opening 17.

The extension 20 penetrates inside the channel 16, in order to reduce its volume (to be filled in use by the ink) and to contribute to convey the ink to the relevant side slot 6.

Conveniently, the plug 18 is designed with a symmetrical shape in at least one of the two longitudinal, orthogonal planes identified by the lines x, y shown in FIG. 3, preferably in both planes. This makes the plug handling for the assembly easier, preventing assembling errors due to misplacement of the plugs.

The channels 16 are separated by a wall 22 which extends with its end wall 23 to the front surface of the cartridge body, so that the two recesses 21 are separated and independent from each other.

The plugs 18 are attached to the body 1 by an ink-tight seal, for example made of a layer of adhesive resin or glue, ultrasonic welding or the like.

A layer of adhesive resin or glue 24, laid on the front face of the recess 21 is preferred. The front flange 19 abuts against such adhesive resin layer 24 and ensures the tight seal of each of the openings 17.

The adhesive 24 can be applied in both the recesses 21 with a single application from the front side of the cartridge, without requiring movements or orientations of the body during the adhesive application.

As the two plugs 18 are in side by side position, they can be easily assembled in the body 1, for example with an automatic assembling machine, with a single, axial movement, as it would be with a single piece plug.

The end wall 23 maintains the recesses 21 separated from each other, such that a possible ink leak from a defect or the like in the seal of the plugs 18 to the openings 17 may reach the external surface of the body 1 (under the flat cable 8), but is prevented from reaching the adjacent opening 17, so that mixing of inks having different colors is prevented.

In particular, according to the present invention, the seal against the possible migration of one ink from one channel to the other is ensured by the fact that this migration is first prevented by a first line of adhesive, which makes the seal between the flange portion 19 and the recess 21 of one channel; then, the end wall 23 maintains the separation between the two recesses 21; finally, a second line of adhesive provides the seal the flange portion 19 and the recess 21 of the adjacent channel.

Accordingly, a possible leak due to a defect in one sealing line (the adhesive in one recess 21) finds the end wall 23, which prevents such leak to reach the adjacent plug; the contamination of the ink in the second channel might only take place in case the leak from the first channel is such to flow beyond the end wall 23 barrier and a second defect (i.e. a leak) in the adhesive layer in the second recess 21 is experienced.

The combination of all the above unfavorable circumstances is rather unlikely and, accordingly, with the present invention the risk of contamination is practically negligible.

This obviates to a problem experienced with a construction in which the plugs are made in the form of a single piece plug unit 18*a* and a single recess 21*a* is provided for it, as exemplified in FIGS. 9-11. Such construction, for example, is shown in U.S. Pat. No. 6,733,118.

The single piece plug 18*a* is inserted as shown by the arrow F1 in the recess 21*a*. The wall 22*a*, with such construction, is lacking the end wall 23 to divide it into separate recesses and has a substantially flat portion 25 against which the central inner face 26 of the front portion 19*a* of the single piece plug unit 18*a* is intended to lay. The seal, such as an adhesive resin or glue, is applied along the perimeter of the openings 17, including an adhesive line on the surface 25, in order to obtain the desired tightness and separation of the two channels 16.

With such construction the separation of the two channels 16 is granted solely by the adhesive layer line laid over the surface 25.

A possible defect in such adhesive layer line allows the ink of one color, in one of the channels 16 to be guided by the inner face 26 of the front portion 19*a* of the single piece plug unit 18*a* toward the other one of the channels 16, resulting in a contamination of the different color ink present therein, as shown by the arrow F2 in FIG. 10.

In addition, the single piece construction of the plug unit 18*a*, typically to be obtained through injection molding, is subject to deformation from the original shape, for example because of different shrinkages of different portions during cooling (either after molding or after an heating applied later on, for example during the assembly stage), as shown in FIG. 11 with dotted lines (the amount of the deformation in the drawing is increased for better clarity of representation).

Such deformation, difficult to be avoided in production, contributes to cause a defect in the seal in particular in correspondence of the surface 25 and results in a possible contamination of the inks in the two channels 16.

The two plugs construction according to the present invention avoids the above problem, because of many reasons.

Each plug 18 is designed with a symmetrical shape, which minimizes possible deformations due to uneven thermal shrinkages during cooling. Absent such deformation, the probability of defects in the adhesive layer 24 around the periphery of the openings 17 is greatly reduced.

Being the seals of the two openings 17 made independently of each other, only the combined presence of defects in both the seals would possibly lead to a contamination risk.

In addition, the end wall 23 constitutes a barrier to prevent that possible ink leakages from one of the openings 17 reach the other, adjacent one of the openings 17.

Finally, such possible leakages (if any) would in any case be directed to the outside, so that they would have no undesired effect on the print quality.

The presence of the flat cable 8 over the area of the plugs 18, with the relevant adhesive layer, will furthermore prevent such possible leakages (not detected during assembly, or even arising after sale) to reach the outside of the cartridge body and cause stains either on the hands of the user or inside the print machine.

In this respect, it is remarked that in the prior art arrangement described above the flat cable adhesive layer would be of no effect in preventing inks contamination, because it would be the front portion 19*a* itself of the single piece plug unit 18*a* to convey ink from one channel to the other, and such adhesive layer would not intervene. Rather, in the present of leakages, the flat cable adhesive layer would contribute to convey the ink leakage trough the sole pathway available to it, i.e. from one channel 16 to the other through the above discussed adhesive defect.

Preferably, the process for the cartridge manufacturing according to the present invention includes the following steps:

Injection molding of the cartridge body 1, of the lid 4 and of the two plugs 18;

Washing of the molded parts;

Insertion and welding of the ink filters 13;

Insertion of the foam 12;

Lid ultrasonic welding;

Lid sealing test;

Plugs assembly;

Plug sealing test;

Printhead and flat cable assembly;

Ink filling.

After the cartridge has been finally assembled and filled, further tests are performed in order to check its functionality before its acceptance for sale.

The cartridge body and the plugs are preferably made by injection molding in thermoplastic polymeric compound or compounds. Such compounds should provide suitable properties, such as strength, rigidity, dimensional stability, resistance to inks and chemicals and the like.

A convenient thermoplastic polymeric compound suitable to manufacture both the cartridge body and the plugs is a modified thermoplastic resin based on polyphenylene ether (PPE) (for example NORYL SE1 by G.E.); alternative materials include modified PPE resin with glass fibre reinforcement, or PSU (polysulfone) resin. Preferably, such resins contain a flame retardant additive.

In more detail, the plugs assembly included the following steps:

Adhesive resin dispensing around the perimeters of the front openings 17;

Visual control of the correct resin dispensing;

Plugs placement;

Resin thermal curing.

A preferred adhesive resin is an epoxy resin adhesive resin, more preferably a one component epoxy adhesive resin. ECCOBOND E3200 by Emerson & Cuming is a suitable adhesive In order to obtain the curing of the resin in a time compatible with the assembly process requirements, heating of the resin is convenient.

The resin curing is preferably obtained by heating the plugs and the resin by means of hot air blown against the plugs.

An air flow of about 2 minutes, with an air temperature in the proximity of the plugs (3-4 cm) up to about 120°C. has been found adequate to provide the desired adhesive curing.

As the plugs are separate and independent, and both aligned on the front face of the body, no obstructions are placed in front of the areas where the adhesive is laid, which might prevent or reduce the ability of the hot air stream to convey the required heat for the curing of the adhesive resin. Accordingly, the whole perimeter of the openings 17 is accessed by the hot air stream.

As the plugs are independent from each other, and axially symmetric, their heating due to the hot air stream does not cause a dimensional distortion capable of jeopardizing the effectiveness of the seal.

Alternatively, for example in case the heating up to the curing temperature is expected to cause unacceptable deformations in the cartridge body (e.g. because of the material thereof), local heating can be used for curing the adhesive resin, for example generated by microwaves. In such case, carbon filled materials or other microwave absorbing materials may be used to make the plugs.

The invention claimed is:

1. A multi-color ink-jet print cartridge comprising:

an integrally shaped one-piece body having:

a reservoir portion including at least two ink chambers;

a manifold portion including at least two ink conduits, each ink conduit hydraulically connected to a corresponding one of said ink chambers through a port;

an ink-jet printhead, including at least two nozzle arrays, each of said nozzle arrays hydraulically connected to a corresponding one of said ink conduits; and a lid to cover said reservoir portion of the body;

each of said ink conduits including a channel portion in side to side relationship with the corresponding channel portion of the adjacent ink conduit, said channel portions having adjacent openings on one external wall of said body, said adjacent openings each being associated with respective adjacent recesses;

wherein a common wall is arranged for separating said adjacent recesses; and separate independent plugs are sealingly inserted into said adjacent openings.

2. A multi-color ink-jet print cartridge according to claim 1, in which two independent seals seal said plugs into said adjacent openings.

3. A multi-color ink-jet print cartridge according to claim 1, in which said plugs include front flanges arranged to abut against said adjacent openings.

4. A multi-color ink-jet print cartridge according to claim 3, in which an adhesive layer is interposed between each said front flange and said recess.

5. A multi-color ink-jet print cartridge according to claim 1, in which said common wall has a side flush with an outer surface of one external wall of said body.

6. A multi-color ink-jet print cartridge according to claim 1, in which said plugs are symmetrical in one longitudinal plane thereof.

7. A multi-color ink-jet print cartridge according to claim 1, in which said plugs are symmetrical in both the orthogonal and longitudinal planes thereof.

8. A process for manufacturing a multi-color ink-jet print cartridge, which comprises the steps of:

injection molding a one-piece body, including a top opening and at least two adjacent front openings each being associated with respective adjacent recesses in side to side relationship on a body external wall;

sealing said top opening with a lid;

sealing said at least two adjacent front openings with independent plugs, respectively;

assembling a printhead on said body; and filling said cartridge with at least two different inks;

wherein said step of injection molding a one-piece body, including a top opening and at least two adjacent front openings comprises the step of realizing channel portions having a common wall for separating said at least two adjacent front openings.

9. The manufacturing process according to claim 8 in which the step of sealing said front openings includes laying a separate layer of adhesive material around each of said openings.

10. The manufacturing process according to claim 9 in which said layer of adhesive material is thermally cured.

11. The manufacturing process according to claim 10 in which curing said layer of adhesive material includes blowing hot air.

* * * * *